US005845614A

United States Patent [19]

Tanaka et al.

[11] Patent Number: 5,845,614

[45] Date of Patent: Dec. 8, 1998

[54] VALVE OPERATING SYSTEM IN INTERNAL COMBUSTION ENGINE

[75] Inventors: Shigekazu Tanaka; Shigemasa Kajiwara; Junji Yamano; Katsuaki Shiiki; Keiji Miura, all of Saitama, Japan

[73] Assignee: Honda Giken Kogyo Kabushiki Kaisha, Tokyo, Japan

[21] Appl. No.: 972,241

[22] Filed: Nov. 18, 1997

[30] Foreign Application Priority Data

Nov. 19, 1996 [JP] Japan ..... 8-308255

[51] Int. Cl.[6] ..... F01L 13/00

[52] U.S. Cl. ..... 123/90.16; 123/90.44

[58] Field of Search ..... 123/90.15, 90.16, 123/90.17, 90.22, 90.27, 90.39, 90.44, 90.45, 308, 432, 198 F

[56] References Cited

U.S. PATENT DOCUMENTS

| | | | |
|---|---|---|---|
| 4,799,463 | 1/1989 | Konno | 123/90.16 |
| 5,460,130 | 10/1995 | Fukuzawa et al. | 123/90.16 |
| 5,495,832 | 3/1996 | Fujii et al. | 123/90.16 |
| 5,529,032 | 6/1996 | Oikawa et al. | 123/90.16 |
| 5,553,584 | 9/1996 | Konno | 123/90.16 |
| 5,558,060 | 9/1996 | Horie et al. | 123/90.16 |
| 5,592,907 | 1/1997 | Hasebe et al. | 123/90.16 |

FOREIGN PATENT DOCUMENTS

| | | |
|---|---|---|
| 0 267 696 | 5/1988 | European Pat. Off. . |
| 44 14 182 | 10/1995 | Germany . |
| 2-50286 | 11/1990 | Japan . |

OTHER PUBLICATIONS

Patent Abstract of Japan vol. 96, No. 10, published 31 Oct. 1996 & JP 08 158 830A, published 18 Jun. 1996.

Patent Abstracts of Japan, vol. 17, No. 530 (M–1485), published 24 Sep. 1993 & JP 05 141215A, published 8 Jun. 1993.

Patent Abstracts of Japan, vol. 10, No. 167, (M–488), published 13 Jun. 1986 & JP 61 019912 A, published Jan. 28, 1986.

*Primary Examiner*—Weilun Lo

*Attorney, Agent, or Firm*—Nikaido Marmelstein Murray & Oram LLP

[57] ABSTRACT

A valve operating system includes a connection switch-over device provided in a plurality of cam followers. The connection switch-over device has a piston moved in response to a change in hydraulic pressure in a hydraulic pressure chamber. A roller shaft is disposed on at least one of the cam followers and has a roller carried thereon to come into rolling contact with a valve operating cam. In this valve operating system, the hydraulic pressure chamber and a communication passage, which permits an oil supply passage to communicate with the hydraulic pressure chamber, are defined in a particular one of all the cam followers, which moves a smallest amount when the connection switch-over device is in its disconnecting state. The roller shaft, having the roller rotatably carried thereon, is mounted on the cam follower other than the particular one cam follower. Thus, it is possible to avoid an increase in size of the particular one cam follower, and avoid a complicated assembling operation and passage construction. Moreover, the valve operating load is reduced to a minimum by using the roller.

10 Claims, 12 Drawing Sheets

VALVE OPERATING SYSTEM IN INTERNAL COMBUSTION ENGINE

BACKGROUND OF THE INVENTION

1. Field of the Invention

The present invention relates to a valve operating system in an internal combustion engine, and in particular, to a valve operating system including a connection switch-over means and a roller shaft. The connection switch-over means is mounted in a plurality of cam followers and includes a piston that is moved axially in response to a change in hydraulic pressure in a hydraulic pressure chamber. The roller shaft has a roller carried thereon to come into rolling contact with a valve operating cam. The roller shaft is mounted on at least one of the cam followers in an arrangement coaxial with the connection switch-over means in connected states of the cam followers.

2. Description of the Related Art

A valve operating system is conventionally already known, for example, from Japanese Patent Publication No.2-50286. This conventional valve operating system is designed so that the friction loss, of contact portions of the cam followers and the valve operating cam, is reduced by the rolling contact of the roller.

In the above known valve operating system, however, the roller shaft is mounted to all the cam followers. For a cam follower which has a hydraulic pressure chamber and a communication passage defined therein and which permits the hydraulic pressure chamber to communicate with an oil supply passage in a support member, an increase in size thereof cannot be avoided due to the fact that the communication passage is formed to avoid being in the roller shaft. A passage, which connects the communication passage and the hydraulic pressure chamber to each other, can be formed in the roller shaft, while avoiding an increase in size of the cam follower. In this case, however, it is necessary to determine the circumferential position of the roller shaft at a constant location. This results in a complicated operation for assembling the roller shaft to the cam followers. Furthermore, if a passage is provided, without the need for such positioning, in a construction which permits the communication passage and the hydraulic pressure chamber to communicate with each other irrespective of the circumferential position of the roller shaft, passage construction is complicated.

SUMMARY OF THE INVENTION

Accordingly, it is an object of the present invention to provide a valve operating system in an internal combustion engine, wherein the size of the cam follower is not increased and, an assembling operation and passage construction are simplified. Moreover, the valve operating load can be reduced to a minimum by using a roller.

To achieve the above object, according to the present invention, there is provided a valve operating system in an internal combustion engine, comprising a plurality of cam followers which are carried on a common support member having an oil supply passage and which are arranged in a direction parallel to an axis of a cam shaft. The cam followers are operated in response to the rotation of the cam shaft. A connection switch-over means includes a piston operated in response to a change in hydraulic pressure in a hydraulic pressure chamber leading to the oil supply passage. The connection switch-over means is mounted in the plurality of cam followers and is able to switch between a state in which the cam followers are connected to one another and a state in which such connection is released. A roller is rotatably carried on a cylindrical roller shaft mounted on at least one of the cam followers in an arrangement coaxial with the piston in the connecting state of the connection switch-over means. The roller is in rolling contact with a valve operating cam provided on the cam shaft. One of all the cam followers, which moves a smallest amount when the connection switch-over means is in its disconnecting state, is formed with the hydraulic pressure chamber and a communication passage which permits the oil supply passage to communicate with the hydraulic pressure chamber. The roller shaft, having the roller rotatably carried thereon, is mounted to the cam follower other than the particular one cam follower.

With such a construction, since the hydraulic pressure chamber and the communication passage are formed in the particular one cam follower to which the roller shaft and the roller are not mounted, the roller shaft cannot be a hindrance to the formation of the communication passage. Therefore, the communication passage can be easily formed in the particular one cam follower, while avoiding an increase in size of the particular one cam follower, and avoiding a complicated assembling operation and passage construction. Moreover, the cam follower with the roller shaft carrying the roller mounted thereon moves an amount larger than that of the particular one cam follower during disconnection by the connection switch-over means. Therefore, if the cam follower is in direct contact with the valve operating cam, the friction resistance is increased. However, the friction resistance can be reduced by the rolling contact of the roller with the valve operating cam to alleviate the valve operating load.

According to another aspect and feature of the present invention, the particular one cam follower is in direct contact with a stopping cam which is provided on the cam shaft in such a manner that the operation of the particular one cam follower is completely or substantially stopped in the disconnecting state of the connection switch-over means. Thus, since the particular one cam follower is completely or substantially stopped, the friction resistance due to the direct contact by the particular one cam follower with the stopping cam cannot be increased.

According to a further aspect and feature of the present invention, the connection switch-over means includes a piston which is axially moved in response to a change in hydraulic pressure in the hydraulic pressure chamber to switch over the connection and disconnection of the adjacent cam followers. A limiting member limits the movement of the piston to a position permitting the adjacent cam followers to be connected. A return spring exhibits a spring force for resiliently biasing the limiting member and the piston toward the hydraulic pressure chamber. The limiting member is received in the roller shaft which is mounted to the cam follower disposed on the opposite side from the particular one cam follower. The particular one cam follower is disposed at one end in a direction of arrangement of the plurality of cam followers. The return spring is accommodated in the roller shaft. The roller shaft has a radially inward protruding support wall which is integrally provided on its inner surface at a location corresponding to an axially intermediate portion of the roller which is carried on the roller shaft. The return spring is received on the support wall, thereby limiting the movement of the limiting member with the movement of the piston to the position permitting the adjacent cam followers to be connected.

With such a construction, since the support wall is provided on the inner surface of the intermediate portion of the roller shaft, the axial length of the limiting member and the return spring can be relatively shortened while still ensuring a required stroke of the limiting member. Thus, the weight of the limiting member and the return spring and in turn, of the connection switch-over means can be reduced, so that reliability of the limiting member can be enhanced. Moreover, an enhancement in rigidity of the roller shaft can be provided by the support wall, and therefore smooth rotation of the roller can be ensured due to the enhancement in rigidity of the roller shaft.

According to a yet further aspect and feature of the present invention, the roller shaft is mounted on the cam follower other than the particular one cam follower for rotation about its axis. Thus, the piston avoids being brought into vigorous contact with only a particular point of the inner surface of the roller shaft in a state in which the adjacent cam followers have been interconnected by the piston. Thus, uneven wear is prevented from occurring on the inner surface of the roller shaft due to vigorous contact of the piston with the particular point which prevents the switching operation of the connection switch-over means from becoming unreliable due to the uneven wearing of the roller shaft.

According to a further aspect and feature of the present invention, the connection switch-over means includes a piston which is axially moved in response to a change in hydraulic pressure in the hydraulic pressure chamber. The piston switches over the connection and disconnection of the adjacent cam followers. A limiting member limits the movement of the piston to a position permitting the adjacent cam followers to be connected. A return spring exhibits a spring force for resiliently biasing the limiting member and the piston toward the hydraulic pressure chamber. The other cam follower, which is disposed on the opposite side from the particular one cam follower which is disposed at one end in a direction of arrangement of the plurality of cam followers, is provided with a fitting bore which opens at least at one end thereof in the direction of arrangement of the cam followers. The roller shaft fitted in the fitting bore is provided at one end thereof with a flange portion engaged with one end face of the other cam follower in the direction of the arrangement of the cam followers. The return spring is mounted between the roller shaft and the limiting member slidably fitted in the roller shaft.

With such a construction, the flange portion of the roller shaft is urged against the other cam follower by a spring force exhibited by the return spring, so that the roller shaft cannot be released from the fitting bore. Thus, it is unnecessary to provide a special means for inhibiting the releasing of the roller shaft from the fitting bore.

The above and other objects, features and advantages of the invention will become apparent from the following description of the preferred embodiments of the invention in conjunction with the accompanying drawings.

BRIEF DESCRIPTION OF THE DRAWINGS

FIGS. 1 to 5 illustrate a first embodiment of the present invention, wherein FIG. 1 is a vertical sectional view of a valve operating system;

FIG. 2 is a sectional view taken along a line 2—2 in FIG. 1 when a connection switch-over means is in its disconnecting state;

FIG. 3 is a sectional view taken along a line 3—3 in FIG. 2;

FIG. 4 is a sectional view similar to FIG. 2 when the connection switch-over means is in its connecting state;

FIGS. 11 and 12 illustrate a second embodiment of the present invention, wherein FIG. 11 is a cross-sectional view of a portion of a valve operating system when a connection switch-over means is in its disconnecting state; and FIG. 12 is a sectional view similar to FIG. 11, when the connection switch-over means is in its disconnecting state.

DETAILED DESCRIPTION OF THE PREFERRED EMBODIMENTS

Figure 1:
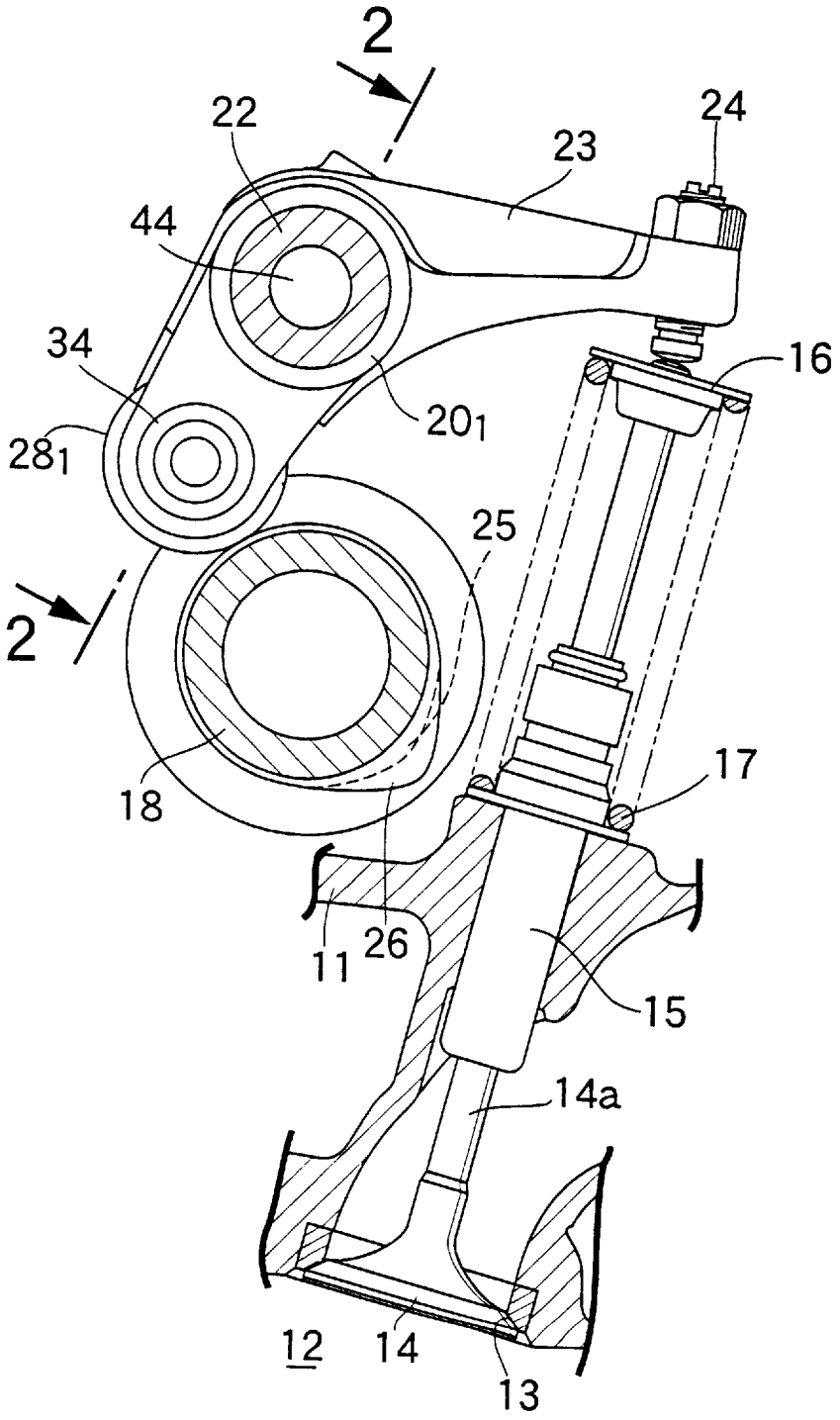

A first embodiment of the present invention will now be described with reference to FIGS. 1 to 5. Referring first to FIG. 1, a pair of intake valve bores 13 are provided in a cylinder head 11 and open into a ceiling surface of a combustion chamber 12. Guide tubes 15 are press-fitted into the cylinder head 11 for axially movably guiding stems 14*a* of intake valves 14 which are capable of opening and closing the intake valve bores 13. Retainers 16 are fixed to upper ends of the stems 14*a* which protrude from the guide tubes 15. Coiled valve springs 17 are mounted between the cylinder head 11 and the retainers 16, so that upward spring forces of the valve springs 17 are applied to the intake valves 14, i.e., in a valve closing direction.

Figure 2:
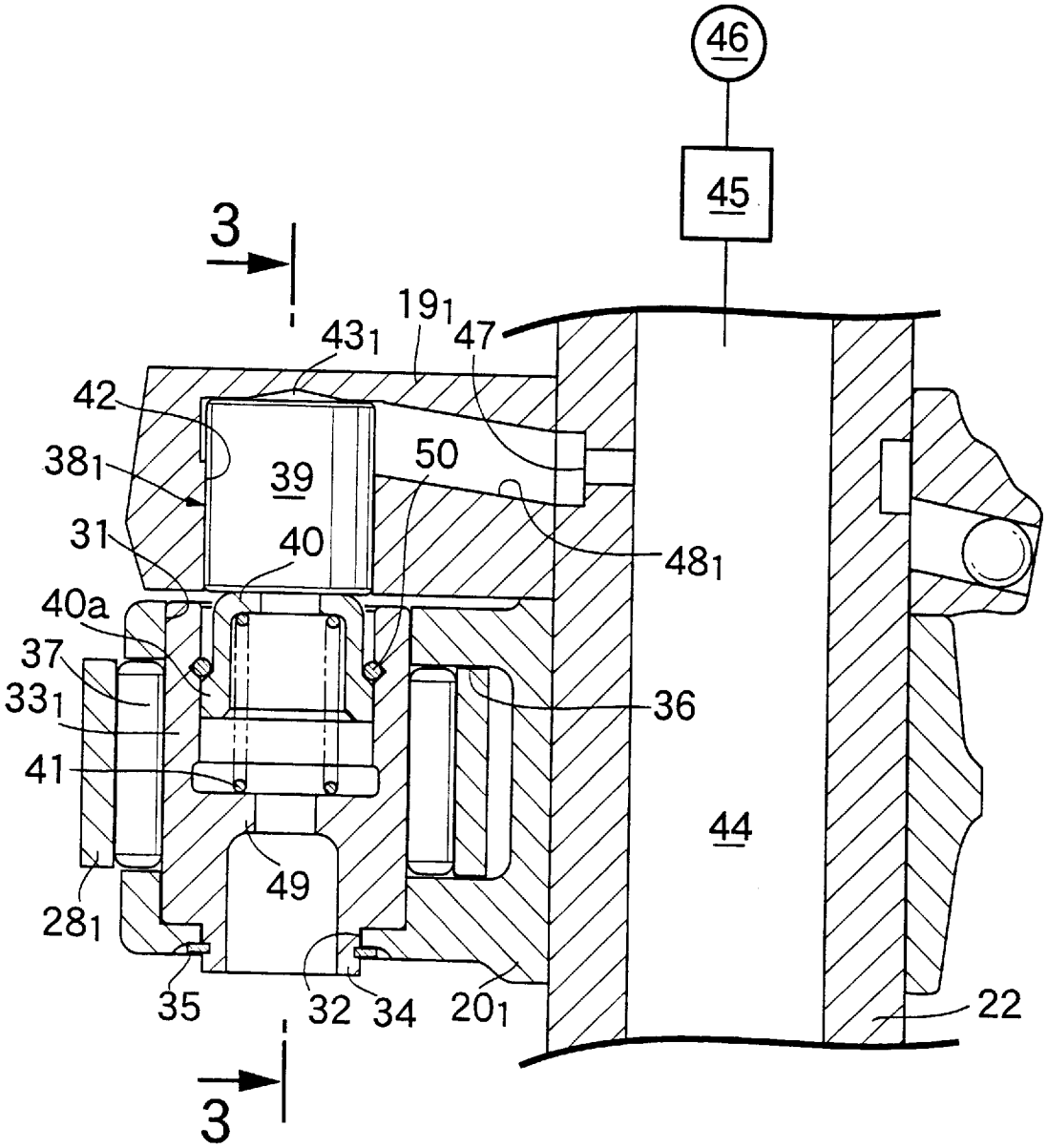
Figure 3:
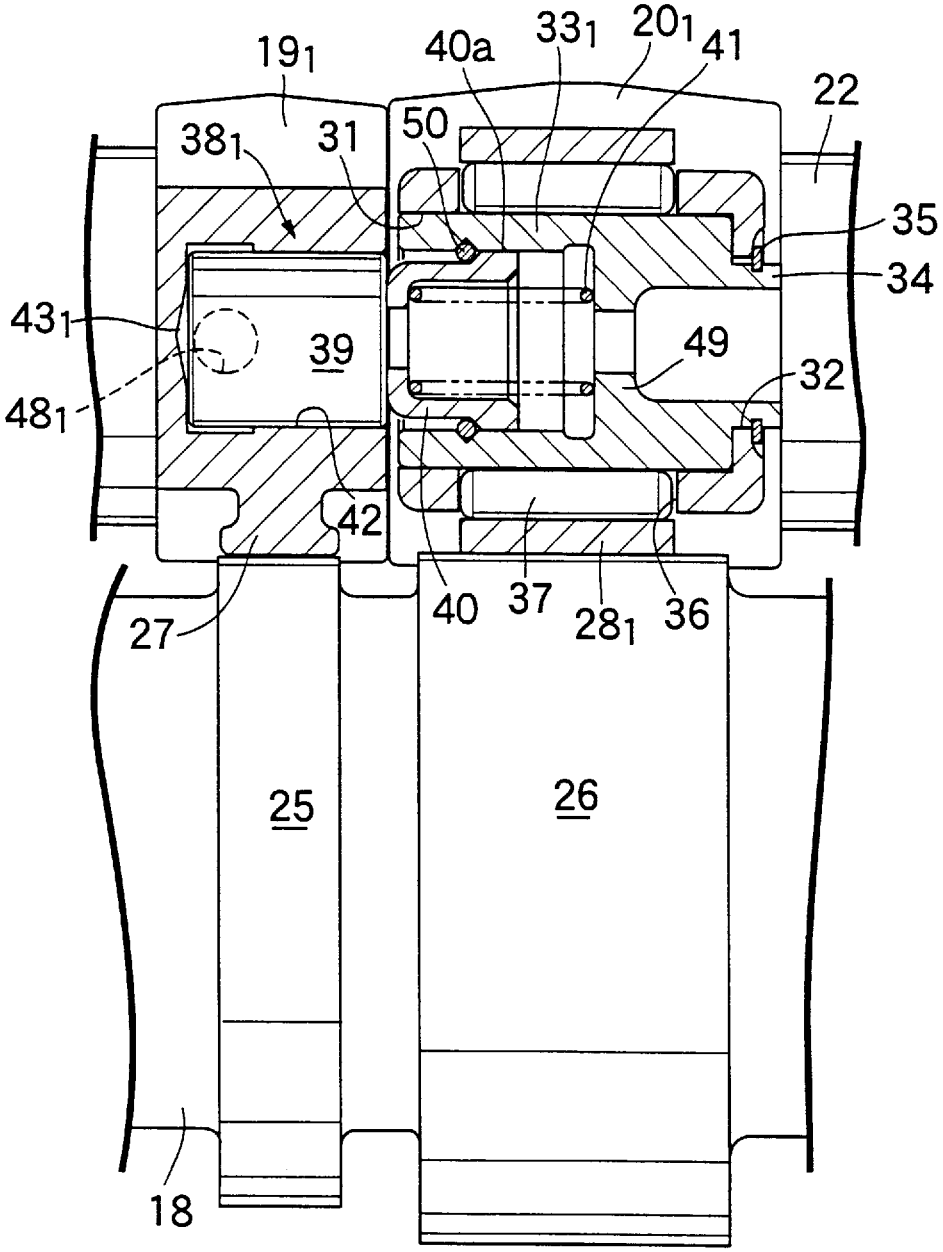

Referring also to FIGS. 2 and 3, a cam shaft 18, which is located above the combustion chamber 12, is rotatably supported by the cylinder head 11 and a cam holder (not shown) coupled to the cylinder head 11. A plurality of, e.g., a pair of first and second rocker arms $\mathbf{19}_1$ and $\mathbf{20}_1$ as cam followers are arranged in a direction parallel to an axis of the cam shaft 18 and are operated in response to the rotation of the cam shaft 18. A rocker arm shaft 22, as a support member having an axis parallel to the cam shaft 18, is fixedly disposed at a location above the cam shaft 18. The rocker arms $\mathbf{19}_1$ and $\mathbf{20}_1$ are swingably carried commonly on the rocker arm shaft 22. The rocker arms $\mathbf{19}_1$ and $\mathbf{20}_1$ are integrally provided with connecting arms 23 extending above the intake valves 14. Tappet screws 24 are threadedly inserted into tip ends of the connecting arms 23 with their advanced and retreated positions capable of being regulated, so as to come into contact with upper ends of the stems 14*a* of the intake valves 14, respectively. Thus, the intake valves 14 are opened and closed in response to the swinging movement of the corresponding rocker arms $\mathbf{19}_1$ and $\mathbf{20}_1$.

The cam shaft 18 is provided with a stopping cam 25 Corresponding to the first rocker arm $\mathbf{19}_1$, and a valve operating cam 26 corresponding to the second rocker arm $\mathbf{20}_1$. The stopping cam 25 is formed so that it permits one of the intake valves 14 to be completely or substantially stopped in a range of lower speed operation of the engine. The valve operating cam 26 is formed to have a cam profile which permits the other intake valve 14 to be opened and closed in a lower speed range of operation of the engine and permits both the intake valves to be opened and closed in a higher speed range of operation of the engine.

On the other hand, at its end opposite from the intake valve 14 with respect to the swinging axis, i.e., the axis of the rocker arm shaft 22, the first rocker arm $\mathbf{19}_1$ as the particular cam follower disposed at one end in the direction of arrangement of the rocker arms $\mathbf{19}_1$ and $\mathbf{20}_1$, is integrally provided with a cam slipper 27 which is in direct contact with the stopping cam 25. In the second rocker arm $\mathbf{20}_1$ as the other cam follower disposed at the other end in the direction of arrangement of the rocker arms $\mathbf{19}_1$ and $\mathbf{20}_1$, a cylindrical roller shaft $\mathbf{33}_1$ is mounted at an end of the second rocker arm $\mathbf{20}_1$ opposite from the intake valve 14 with respect to the swinging axis. A cylindrical roller $\mathbf{28}_1$ rotatably carried on the roller shaft $\mathbf{33}_1$, is in rolling contact with the valve operating cam 26. Moreover, the width of the cam slipper 27 along the axis of the rocker arm shaft 22 is smaller than the length of the roller $\mathbf{28}_1$. The width of the first rocker arm $\mathbf{19}_1$ along the axis of the rocker arm shaft 22 is also smaller than the width of the second rocker arm $\mathbf{20}_1$.

Thus, in the lower speed range of operation of the engine, the first rocker arm $\mathbf{19}_1$ is completely or substantially stopped by the stopping cam 25, thereby causing one of the intake valves 14 to be completely or substantially stopped in its closed state, while the second rocker arm $\mathbf{20}_1$ is swung by the valve operating cam 26, thereby causing the other intake valve 14 to be opened and closed by the second rocker arm $\mathbf{20}_1$. Therefore, even if the first rocker arm $\mathbf{19}_1$ is in direct contact with the stopping cam 25, the friction resistance due to the direct contact of the first rocker arm $\mathbf{19}_1$ with the stopping cam 25 cannot be increased, because the first rocker arm $\mathbf{19}_1$ is in its completely or substantially stopped state.

A bottomed fitting bore 31, opening toward the first rocker arm $\mathbf{19}_1$, is provided in the second rocker arm $\mathbf{20}_1$ in parallel to the rocker arm shaft 22. An insertion bore 32 is coaxially provided in a central portion of a closed end of the fitting bore 31. The cylindrical roller shaft $\mathbf{33}_1$ is fitted into the fitting bore 31 for rotation about an axis within the fitting bore 31 and received on an inner surface of the closed end of the fitting bore 31. Moreover, the roller shaft $\mathbf{33}_1$ is coaxially and integrally provided with a smaller-diameter cylindrical portion 34 which coaxially passes through the insertion bore 32. A retaining ring 35 is mounted around an outer periphery of the smaller-diameter cylindrical portion 34 to engage an outer surface of the closed end of the fitting bore 31.

A slit 36 is provided in the second rocker arm $\mathbf{20}_1$ to traverse an intermediate portion of the fitting bore 31. The roller $\mathbf{28}_1$ is disposed in the slit 36 to coaxially surround the roller shaft $\mathbf{33}_1$. A plurality of needle bearings 37 are interposed between the roller $\mathbf{28}_1$ and the roller shaft $\mathbf{33}_1$. Therefore, the roller $\mathbf{28}_1$ is rotatably carried on the roller shaft $\mathbf{33}_1$.

A connection switch-over means $\mathbf{38}_1$ is mounted in the first and second rocker arms $\mathbf{19}_1$ and $\mathbf{20}_1$ which are disposed adjacent to each other. The connection switch-over means $\mathbf{38}_1$ is capable of switching-over the connection and disconnection of the rocker arms $\mathbf{19}_1$ and $\mathbf{20}_1$. The connection switch-over means $\mathbf{28}_1$ switches between a state in which the rocker arms $\mathbf{19}_1$ and $\mathbf{20}_1$ are operated relative to each other in the lower speed range of operation of the engine, and a state in which the rocker arms $\mathbf{19}_1$ and $\mathbf{20}_1$ are operated in operative association with each other in the higher speed range of operation of the engine.

The connection switch-over means $\mathbf{38}_1$ includes a piston 39 adapted to switch-over the connection and disconnection of the rocker arms $\mathbf{19}_1$ and $\mathbf{20}_1$, a limiting member 40 for limiting the movement of the piston 39 toward a position in which the rocker arms $\mathbf{19}_1$ and $\mathbf{20}_1$ are connected to each other, and a return spring 41 for exhibiting a spring force for resiliently biasing the limiting member 40 and the piston 39 in a disconnecting direction.

A bottomed slide bore 42, opening toward the second rocker arm $\mathbf{20}_1$, is provided in the first rocker arm $\mathbf{19}_1$ at a location corresponding to the roller shaft $\mathbf{33}_1$ on the second rocker arm $\mathbf{20}_1$ and is extended in parallel to the rocker arm shaft 22. The piston 39 is slidably received in the slide bore 42. A hydraulic pressure chamber $\mathbf{43}_1$ is defined within the first rocker arm $\mathbf{19}_1$ between one end of the piston 39 and the closed end of the slide bore 42. The piston 39 is slidably received in the slide bore 42, so that the other end thereof can be fitted into the roller shaft $\mathbf{33}_1$ of the second rocker arm $\mathbf{20}_1$ in response to an increase in hydraulic pressure in the hydraulic pressure chamber $\mathbf{43}_1$.

An oil supply passage 44 is coaxially defined within the rocker arm shaft 22 and is connected to a hydraulic pressure source 46 through a control valve means 45. Pressure of a working oil, from the hydraulic pressure source 46, is switched between lower and higher levels by the control valve means 45 and supplied to the oil supply passage 44. Moreover, an annular groove 47 is provided around an outer periphery of the rocker arm shaft 22 at a location corresponding to the first rocker arm $\mathbf{19}_1$ to lead to the oil supply passage 44. A communication passage $\mathbf{48}_1$ is defined in the first rocker arm $\mathbf{19}_1$ to put the annular groove 47, i.e., the oil supply passage 44 into communication with the hydraulic pressure chamber $\mathbf{43}_1$ irrespective of the swinging state of the first rocker arm $\mathbf{19}_1$.

The limiting member 40 is formed into a hat-like shape with its portion opposite from the piston 39 being opened. The limiting member 40 is coaxially connected at one end thereof to the other end of the piston 39. Moreover, the limiting member 40 is provided at the opened end, i.e., at the other end thereof, with a flange portion 40*a* which protrudes radially outwards. The limiting member 40 is slidably fitted into the roller shaft $\mathbf{33}_1$ in such a manner that the flange portion 40*a* is guided on an inner surface of the roller shaf $\mathbf{33}_1$.

A radially inward protruding support wall 49 is integrally provided on the inner surface of the roller shaft $\mathbf{33}_1$ at a location corresponding to an axially intermediate portion of the roller $\mathbf{28}_1$ which is carried on the roller shaft $\mathbf{33}_1$. The return spring 41 is accommodated within the roller shaft $\mathbf{33}_1$, so that it is located between the support wall 49 and the limiting member 40. Movement of the limiting member 40 and the piston 39 to a position permitting the rocker arms $\mathbf{19}_1$ and $\mathbf{20}_1$ to be connected to each other, is limited by the limiting member 40 brought into contact with the support wall 49. A retaining ring 50, which is capable of being engaged with the flange portion 40*a* of the limiting member 40, is mounted to the inner surface of the roller shaft $\mathbf{33}_1$ at one end thereof to inhibit the limiting member 40 from being released from the roller shaft $\mathbf{33}_1$. However, the retaining ring 50 may be omitted, as described hereinafter.

With such a connection switch-over means $\mathbf{38}_1$, in the lower speed range of operation of the engine, the hydraulic pressure in the hydraulic pressure chamber $\mathbf{43}_1$ is controlled to be at a lower level. The contact end faces of the piston 39 and the limiting member 40 are at locations corresponding to between the first and second rocker arms $\mathbf{19}_1$ and $\mathbf{20}_1$, as shown in FIGS. 2 and 3. Therefore, the rocker arms $\mathbf{19}_1$ and $\mathbf{20}_1$ are swingable relative to each other, so that one of the intake valves 14 is brought into its completely or substantially stopped state by the stopping cam 25, while the other intake valve 14 is opened and closed with an operational characteristic which depends upon the valve operating cam 26.

Figure 4:
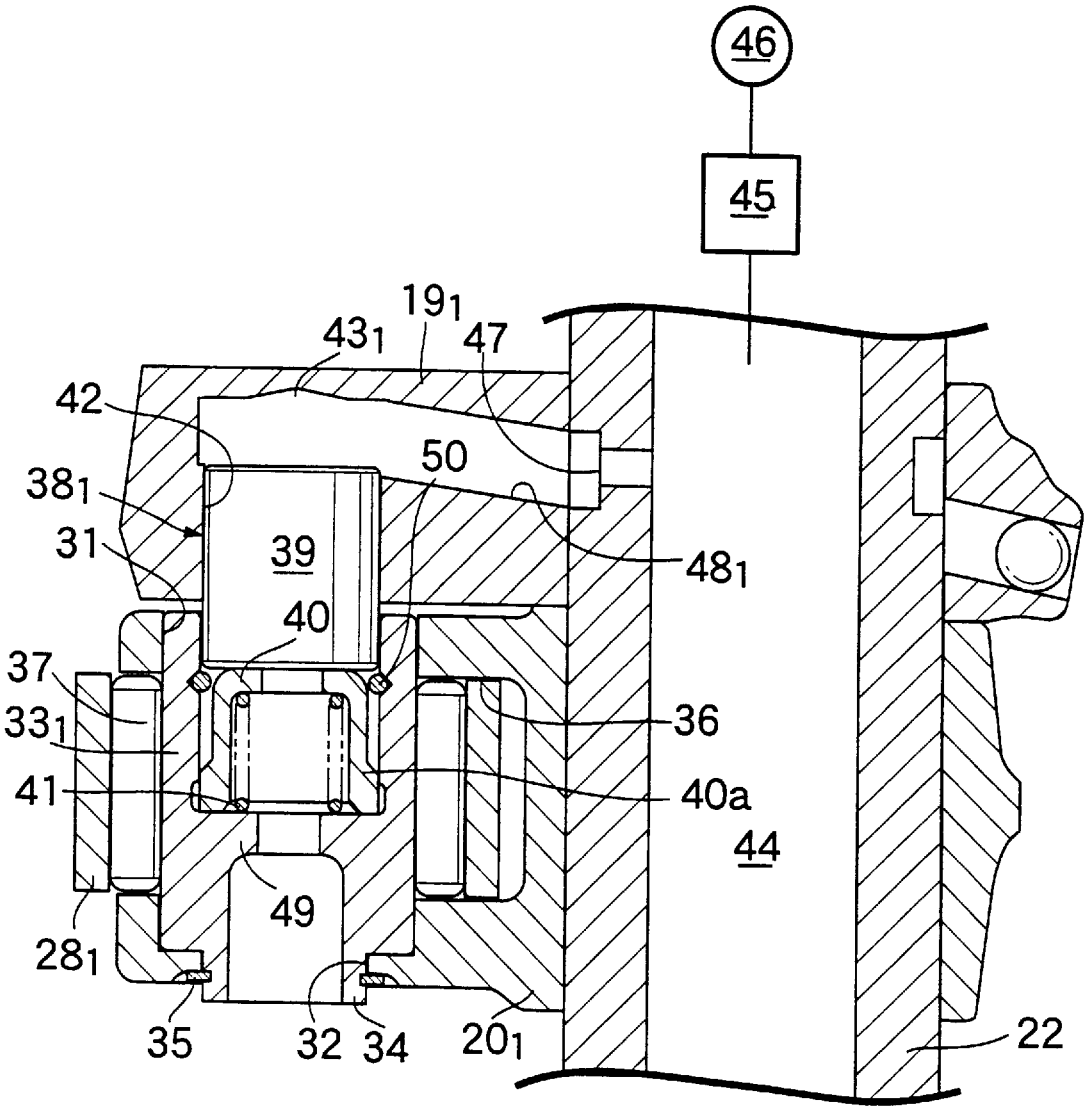

In the higher speed range of operation of the engine, the hydraulic pressure in the hydraulic pressure chamber $\mathbf{43}_1$ is controlled to be at the higher level, and as shown in FIG. 4, the piston 39 is fitted into the roller shaft $\mathbf{33}_1$ of the second rocker arm $\mathbf{20}_1$ while urging the limiting member 40. Therefore, the rocker arms $\mathbf{19}_1$ and $\mathbf{20}_1$ are integrally connected to each other through the piston 39, so that the intake valves 14 are opened and closed with operational characteristics which depend upon the valve operating cam 26.

By changing the opening and closing operational characteristics of the intake valves 14 in the above manner in the lower and higher speed ranges of operation of the engine, the engine output can be enhanced for a valve operating characteristic suitable to the operational state of the engine.

The operation of the first embodiment will be described below. Since the hydraulic pressure chamber $\mathbf{43}_1$ and the communication passage $\mathbf{48}_1$ are formed in a particular one of the first and second rocker arms $\mathbf{19}_1$ and $\mathbf{20}_1$ as the cam follower, to which the roller shaft $\mathbf{33}_1$ and the roller $\mathbf{28}_1$ are not mounted, i.e., the first rocker arm $\mathbf{19}_1$, the roller shaft $\mathbf{33}_1$ cannot be a hindrance to the formation of the communication passage $\mathbf{48}_1$. Thus, an increase in the size of the first rocker arm $\mathbf{19}_1$ can be avoided so that the communication passage $\mathbf{48}_1$ is easily formed in the first rocker arm $\mathbf{19}_1$. Moreover, since the roller shaft $\mathbf{33}_1$ is not mounted in the first rocker arm $\mathbf{19}_1$, the assembling operation can be simplified. Furthermore, the passage construction between the communication passage $\mathbf{48}_1$ and the hydraulic pressure chamber $\mathbf{43}_1$ is not complicated.

Moreover, the second rocker arm $\mathbf{20}_1$, having the roller shaft $\mathbf{33}_1$ and the roller $\mathbf{28}_1$ mounted thereto, is moved a larger amount than the amount of movement of the first rocker arm $\mathbf{19}_1$ during disconnection by the connection switch-over means $\mathbf{38}_1$. If the second rocker arm $\mathbf{20}_1$ is in direct contact with the valve operating cam 26, the friction resistance is increased, but the friction resistance can be reduced by the rolling contact of the roller $\mathbf{28}_1$ with the valve operating cam 26 to alleviate the valve operating load.

The radially inward protruding support wall 49 is integrally provided on the inner surface of the roller shaft $\mathbf{33}_1$ mounted to the second rocker arm $\mathbf{20}_1$ at the location corresponding to the axially intermediate portion of the roller $\mathbf{28}_1$ carried on the roller shaft $\mathbf{33}_1$. The return spring 41 is received on the support wall 49, and the end of the movement of the limiting member 40 with the movement of the piston 39 toward the position permitting the rocker arms $\mathbf{19}_1$ and $\mathbf{20}_1$ to be connected to each other is limited by the support wall 49. Therefore, the axial length of the limiting member 40 and the return spring 41 can be relatively shortened while still ensuring a required stroke of the limiting member 40. Additionally, the weight of the limiting member 40 and the return spring 41 and, in turn, of the connection switch-over means $\mathbf{38}_1$ can be reduced. Thus, the reliability of the limiting member 40 can be enhanced. Moreover, the rigidity of the roller shaft $\mathbf{33}_1$ can be enhanced by the support wall 49, and therefor smooth rotation of the roller $\mathbf{28}_1$ can be ensured due to the enhancement in rigidity of the roller shaft $\mathbf{33}_1$.

The retaining ring 35, for inhibiting the releasing of the roller shaft $\mathbf{33}_1$ from the fitting bore 31 in the second rocker arm $\mathbf{20}_1$, is mounted on the smaller-diameter cylindrical portion 34 of the roller shaft $\mathbf{33}_1$ mounted to the second rocker arm $\mathbf{20}_1$, but the roller shaft $\mathbf{33}_1$ is urged against the closed end of the fitting bore 31 by the spring force exhibited by the return spring of the connection switch-over means $\mathbf{38}_1$. Hence, after completion of the assembling of the connection switch-over means $\mathbf{38}_1$, the roller shaft $\mathbf{33}_1$ cannot be released from the fitting bore 31. Namely, the retaining ring 35 acts to inhibit the releasing of the roller shaft $\mathbf{33}_1$ from the fitting bore 31 in the course of the assembling of the connection switch-over means $\mathbf{38}_1$, and after completion of the assembling of the connection switch-over means $\mathbf{38}_1$, the retaining ring 35 may be removed.

Figure 5A:
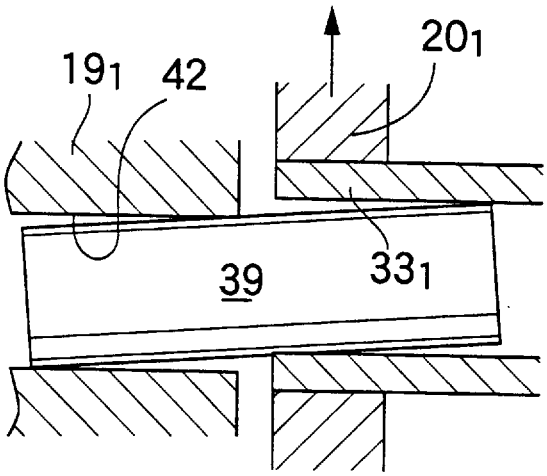
FIGS. 5A and 5B are schematic views of a portion of the connection switch-over means for explaining the operation when an uneven wearing has been produced on a roller shaft.
Figure 5B:
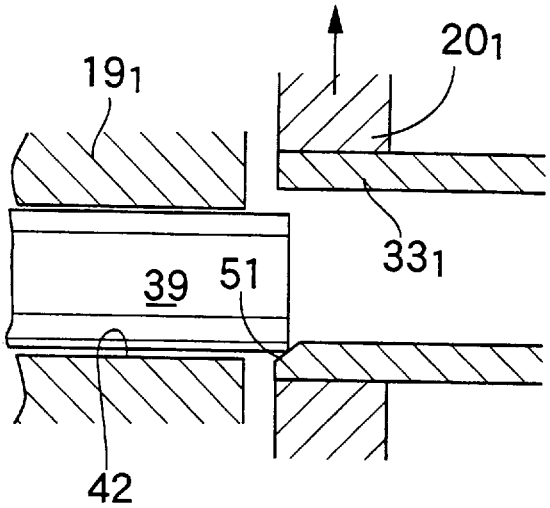

Further, the roller shaft $\mathbf{33}_1$ is mounted in the second rocker arm $\mathbf{20}_1$ for rotation about its axis. Thus, the piston 39 can avoid being brought into vigorous contact with a particular point of the inner surface of the roller shaft $\mathbf{33}_1$ as a result of the movement of the rocker arms $\mathbf{19}_1$ and $\mathbf{20}_1$ relative to each other. More specifically, when the rocker arms $\mathbf{19}_1$ and $\mathbf{20}_1$ are connected to each other by the piston 39, the force of operation of the second rocker arm $\mathbf{20}_1$ by the valve operating cam 26 is transmitted to the first rocker arm $\mathbf{19}_1$ through the piston 39. However, due to the presence of a small gap between the inner surface of the slide bore 42 as well as the inner surface of the roller shaft $\mathbf{33}_1$ and the outer surface of the piston 39, the piston 39 is brought into vigorous contact with a portion of an end edge of the roller shaft $\mathbf{33}_1$ on the side of the first rocker arm $\mathbf{19}_1$, as shown in FIG. 5A. If the roller shaft $\mathbf{33}_1$ is mounted to the second rocker arm $\mathbf{20}_1$ for non-rotation about the axis, then the piston 39 is brought into vigorous contact with the roller shaft $\mathbf{33}_1$ at the particular point to create an unevenly worn portion 51 at the particular point of the roller shaft $\mathbf{33}_1$, as shown in FIG. 5B. If such an unevenly worn portion 51 is created, when the operation of the rocker arms $\mathbf{19}_1$ and $\mathbf{20}_1$ relative to each other by the stopping cam 25 and the valve operating cam 26 is started as the operation of the piston 39 is started to connect the rocker arms $\mathbf{19}_1$ and $\mathbf{20}_1$ to each other, a tip end of the piston 39 is brought into contact with the unevenly worn portion 51 and urged back toward the first rocker arm $\mathbf{19}_1$. As a result, the connection of the rocker arms $\mathbf{19}_1$ and $\mathbf{20}_1$ to each other by the piston 39 may not be achieved in some cases. However, if the roller shaft $\mathbf{33}_1$ is rotatable about its axis, the piston 39 cannot be brought into vigorous contact with any particular point of the roller shaft $\mathbf{33}_1$ and therefore, such an unevenly worn portion 51 cannot be formed. Thus, the connection of the rocker arms $\mathbf{19}_1$ and $\mathbf{20}_1$ to each other by the piston 39 can be reliably performed, thereby enhancing the accuracy of switching-over of the connection and disconnection of the rocker arms $\mathbf{19}_1$ and $\mathbf{20}_1$ by the connecting switch-over means $\mathbf{38}_1$.

In the above-described embodiment, the movement of the limiting member 40 is limited by direct contact of the limiting member 40 with the support wall 49. However, even if the limiting member 40 is not brought into direct contact with the support wall 49, the movement of the limiting member 40 may be limited by compressing the return spring 41 to the maximum.

Figure 6:
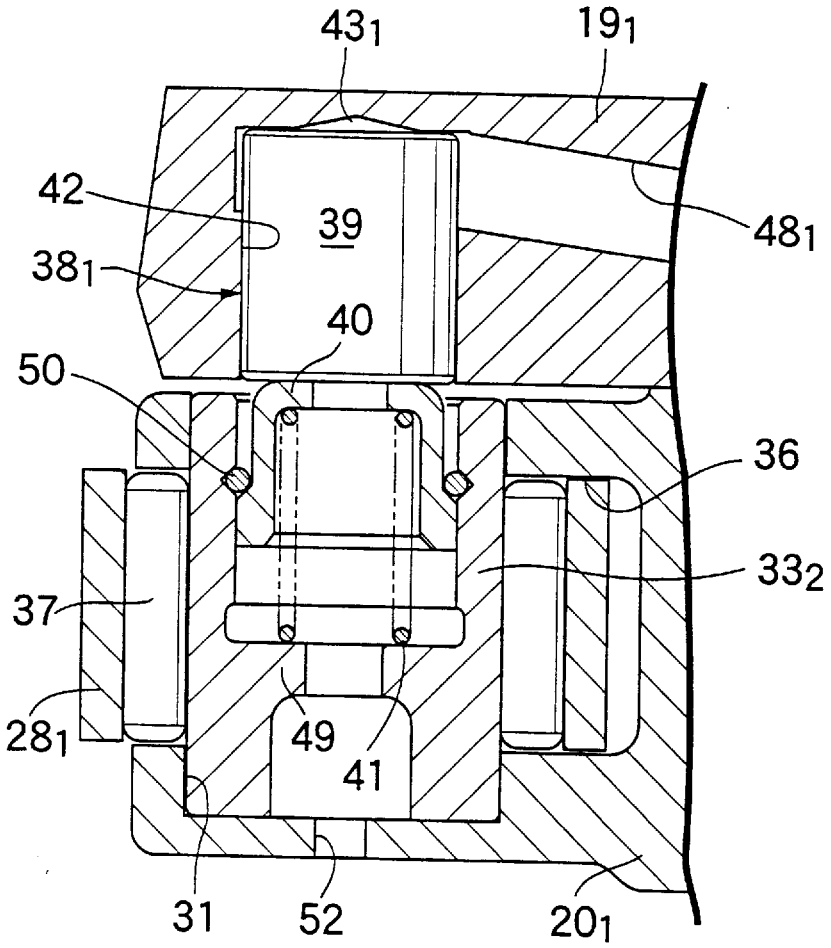
FIG. 6 is a sectional view similar to FIG. 2, but illustrating a first modification to the roller shaft.

FIG. 6 illustrates a first modification to the roller shaft. A roller shaft $\mathbf{33}_2$ is formed into a cylindrical shape and has the support wall 49 on an inner surface at an intermediate portion thereof. The roller shaft $\mathbf{33}_2$ is fitted into the fitting bore 31 in the second rocker arm $\mathbf{20}_1$ in such a manner that it is received on the closed end of the fitting bore 31. The roller $\mathbf{28}_1$ is carried on the roller shaft $\mathbf{33}_2$ with a plurality of needle bearings 37 interposed therebetween. The limiting member 40 of the connection switch-over means $\mathbf{38}_1$ is slidably received in the roller shaft $\mathbf{33}_2$. The return spring 41, accommodated in the roller shaft $33_2$ is disposed between the limiting member 40 and the support wall 49. An opened bore 52, which is opened to outside, is provided in the closed end of the fitting bore 31.

In this first modification, the roller shaft $33_2$ is urged against the closed end of the fitting bore 31 by a spring force exhibited by the return spring 41 of the connection switchover means $38_1$. Hence, the roller shaft $33_2$ cannot be released from the fitting bore 31. Thus, it is unnecessary to provide a special means for inhibiting the releasing of the roller shaft $33_2$ from the fitting bore 31.

Figure 7:
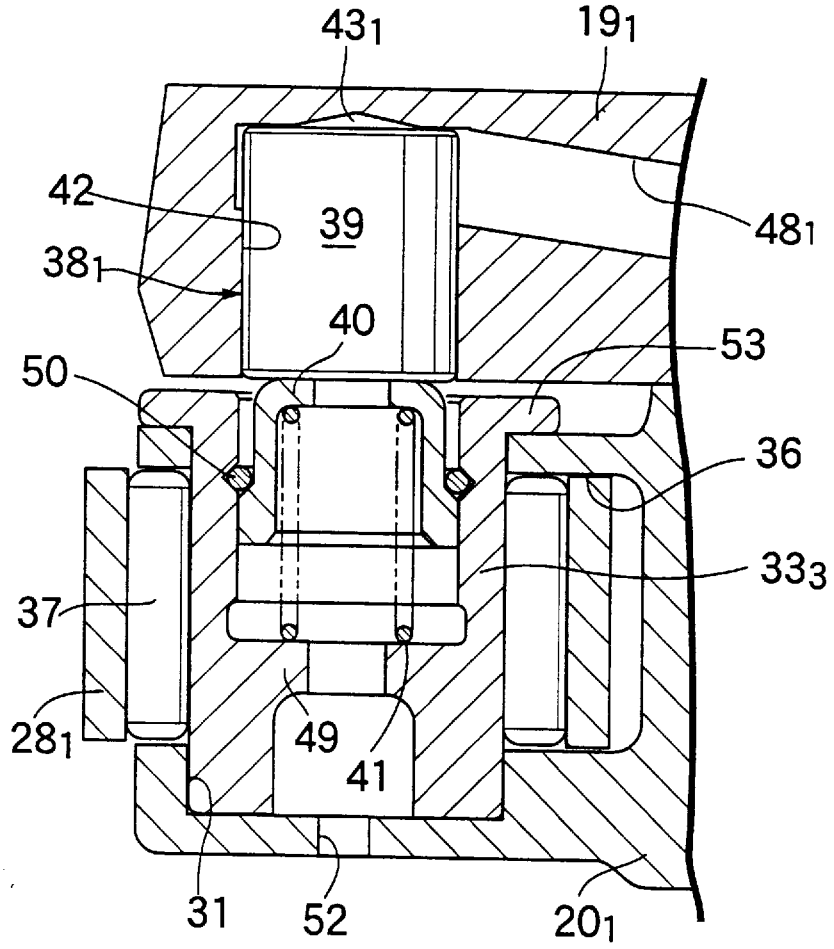
FIG. 7 is a sectional view similar to FIG. 2, but illustrating a second modification to the roller shaft.

FIG. 7 illustrates a second modification to the roller shaft. A roller shaft $33_3$ is formed into a cylindrical shape and has the support wall 49 at an inner surface of an intermediate portion thereof. The roller shaft $33_3$ is fitted into the fitting bore 31 in the second rocker arm $20_1$. A flange portion 53 protruding radially outwards is integrally provided at one end of the roller shaft $33_3$ in such a manner that it is engaged with the second rocker arm $20_1$ at a peripheral edge of the opened end of the fitting bore 31. The roller $28_1$ is carried on the roller shaft $33_3$ with a plurality of needle bearings 37 interposed therebetween.

In the second modification, the flange portion 53 of the roller shaft $33_3$ is urged against the second rocker arm $20_1$ by the spring force exhibited by the return spring 41 of the connection switch-over means $38_1$, so that the roller shaft 333 cannot be released from the fitting bore 31. Thus, it is unnecessary to provide a special means for inhibiting the releasing of the roller shaft $33_3$ from the fitting bore 31.

Figure 8:
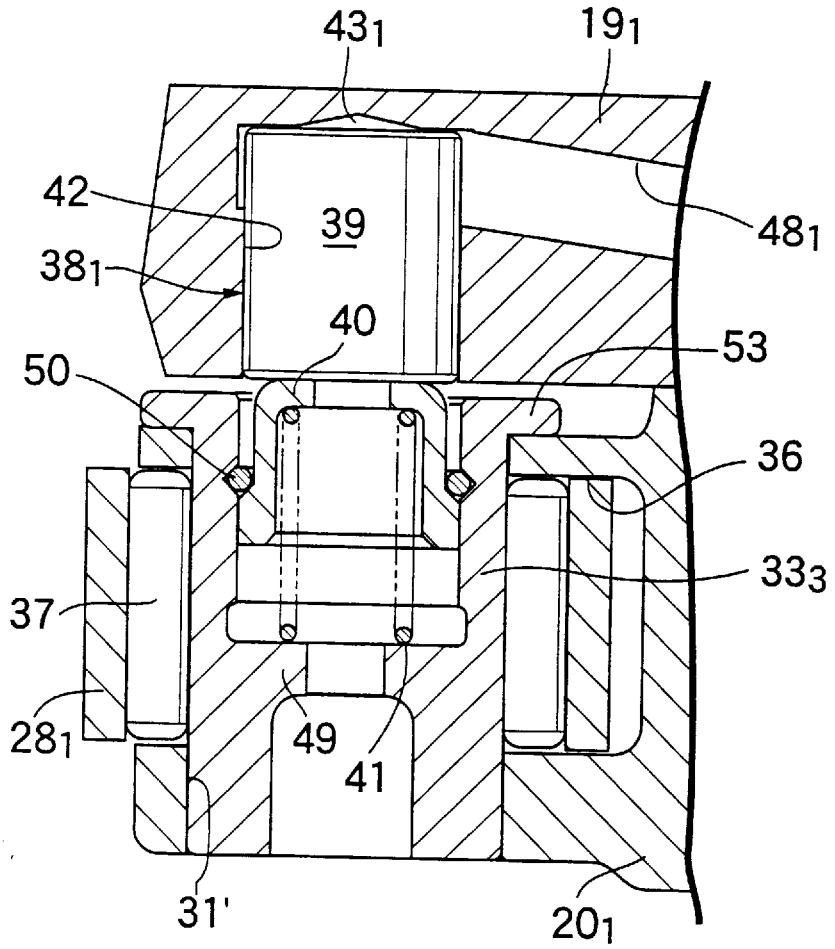
FIG. 8 is a sectional view similar to FIG. 2, but illustrating a modification to the mounting of the roller shaft to the rocker arm in FIG. 7.

FIG. 8 illustrates a modification to the mounting of the roller shaft to the rocker arm in FIG. 7. The cylindrical roller shaft $33_3$, having the flange portion 53 integrally provided at one end thereof, is fitted in a fitting bore 31 provided in the second rocker arm $20_1$ with its opposite ends being opened.

Figure 9:
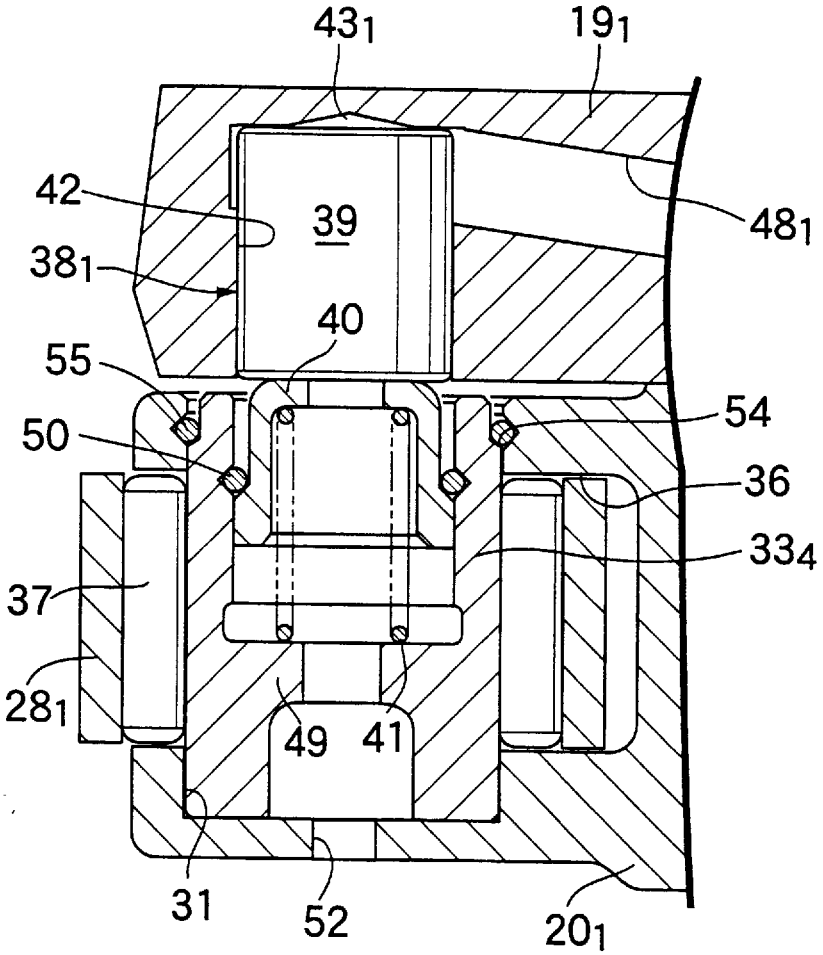
FIG. 9 is a sectional view similar to FIG. 2, but illustrating a third modification to the roller shaft.

FIG. 9 illustrates a third modification to the roller shaft. A roller shaft $33_4$, having the roller $28_1$ carried thereon with a plurality of needle bearings 37 interposed therebetween, is formed into a cylindrical shape and has the support wall 49 on an inner surface at an intermediate portion thereof. The roller shaft $33_4$ is fitted into the fitting bore 31 in the second rocker arm $20_1$. An annular step 54 is provided around an outer periphery of one end of the roller shaft $33_4$ which faces toward the first rocker arm $19_1$. A retaining ring 55 is mounted to an inner surface of one end of the fitting bore 31 to engage the step 54.

Even in the third modification, the return spring 41 of the connection switch-over means $38_1$ is mounted between the limiting member 40 and the support wall 49. Hence, the roller shaft $33_4$ is urged against the closed end of the fitting bore 31 by the spring force exhibited by the return spring 41. Therefore, after completion of the assembling of the connection switch-over means $38_1$, the roller shaft $33_4$ cannot be released from the fitting bore 31. Thus, after completion of the assembling of the connection switch-over means $38_1$, the retaining ring 55 may be removed.

Figure 10:
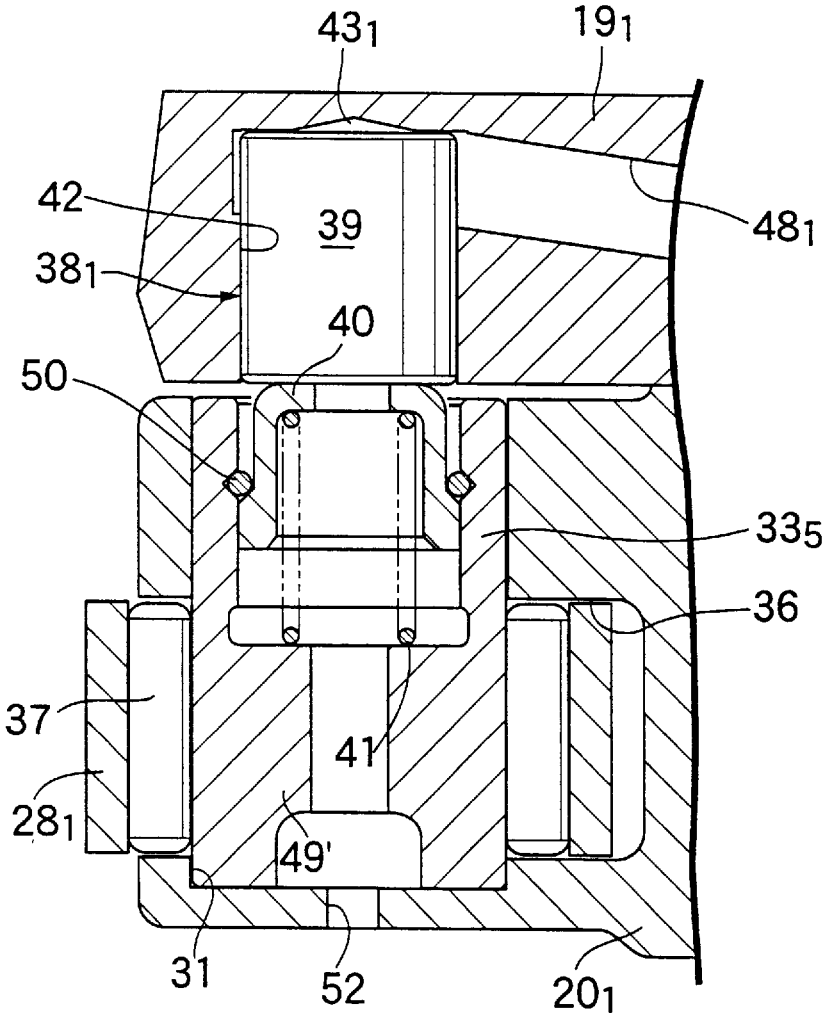
FIG. 10 is a sectional view similar to FIG. 2, but illustrating a fourth modification to the roller shaft.

FIG. 10 illustrates a fourth modification to the roller shaft. A roller shaft $33_5$ is formed into a cylindrical shape and has a support wall 49 on an inner surface at an intermediate portion thereof. The roller shaft $33_5$ is fitted into the fitting bore 31 in the second rocker arm $20_1$ in such a manner that it is received on the closed end of the fitting bore 31. The roller $28_1$ is carried on the roller shaft $33_5$ with a plurality of needle bearings 37 interposed therebetween. The limiting member 40 of the connection switch-over means $38_1$ is slidably received in the roller shaft $33_5$. The return spring 41, accommodated in the roller shaft $33_5$, is disposed between the limiting member 40 and the support wall 49. Moreover, the support wall 49 is formed on the roller shaft $33_5$, so that the thickness in an axial direction of the roller shaft $33_5$ is relatively large over the substantially entire axial length of the roller $28_1$.

In the fourth modification, the rigidity of the roller shaft $33_5$ can be further enhanced by the support wall 49, and therefore smooth rotation of the roller $28_1$ can be ensured due to the enhancement in rigidity of the roller shaft $33_5$.

Figure 11:
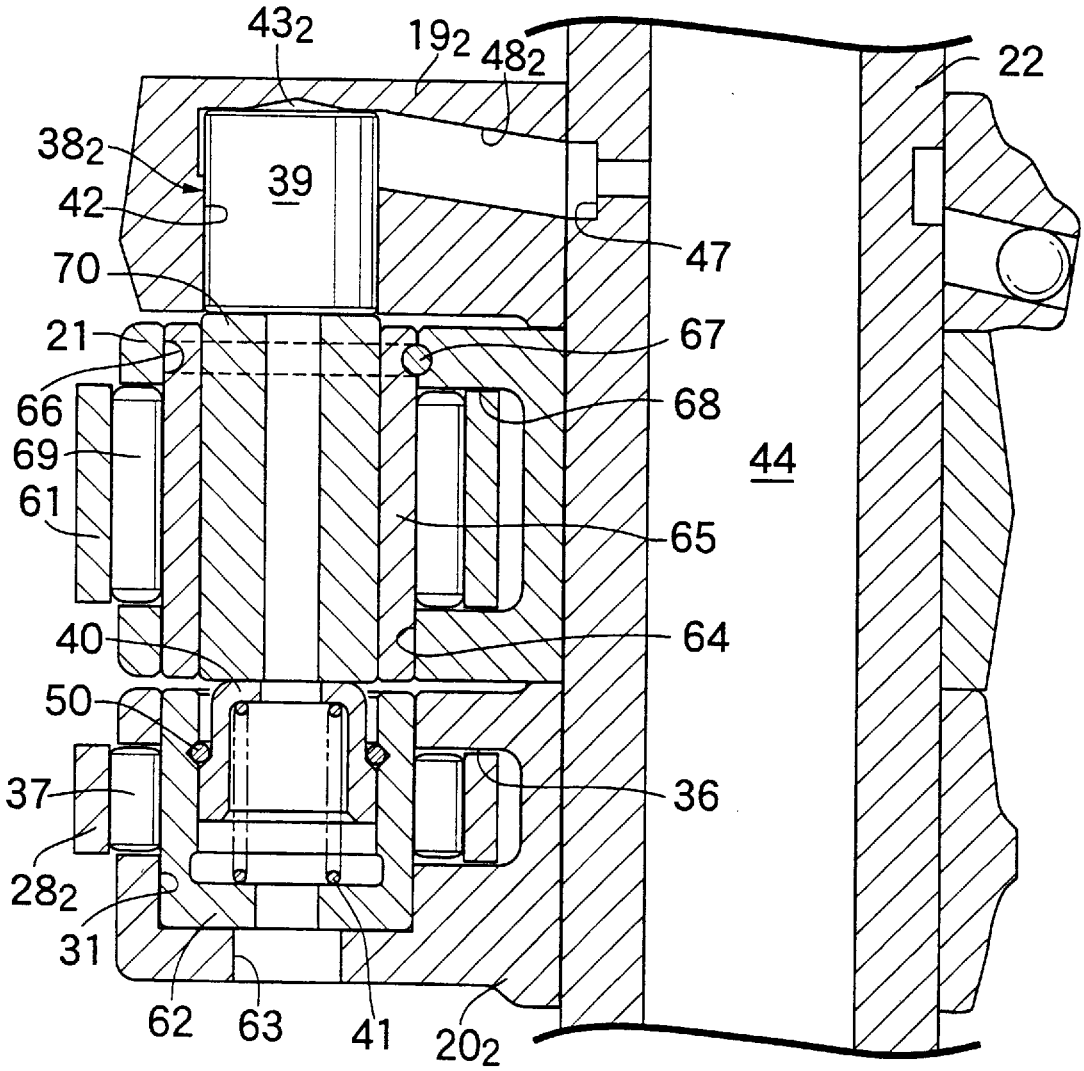
Figure 12:
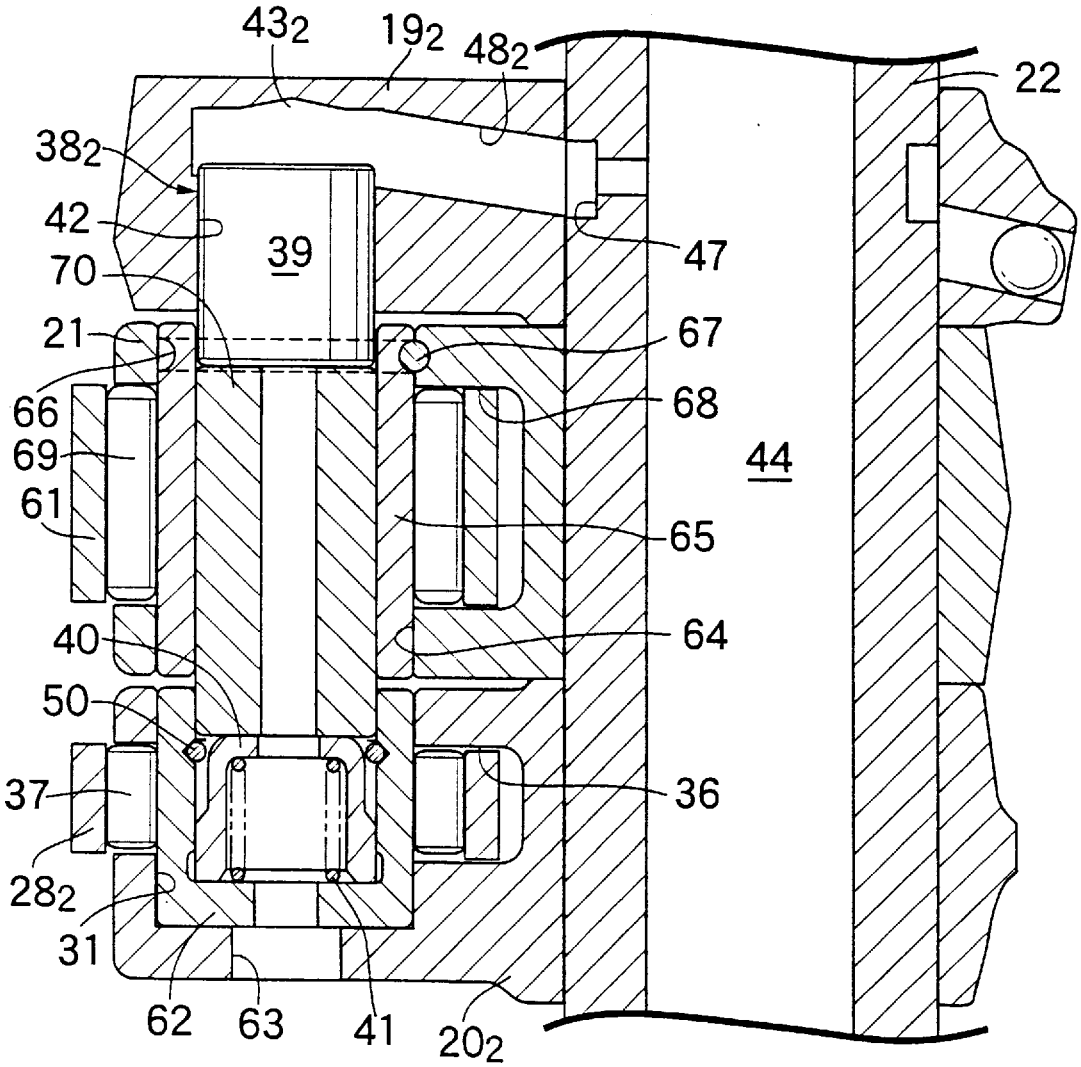

FIGS. 11 and 12 illustrate a second embodiment of the present invention. FIG. 11 is a cross-sectional view showing a portion of a valve operating system when the connection switch-over means is in its disconnecting state, and FIG. 12 is a sectional view, similar to FIG. 11, when the connection switch-over means is in its connecting state.

A first rocker arm $19_2$ as a cam follower, a second rocker arm $20_2$ as a cam follower and a third rocker arm 21 as a cam follower are swingably carried on a rocker arm shaft 22 in such a manner that the third rocker arm 21 is sandwiched between the first and second rocker arms $19_2$ and $20_2$. Intake valves are operatively connected to the first and second rocker arms $19_2$ and $20_2$, respectively.

A cam shaft, which is not shown, is provided with a stopping cam corresponding to the first rocker arm $19_2$, and valve operating cams corresponding to the second and third rocker arms $20_2$ and 21, respectively. The stopping cam is in direct contact with the first rocker arm $19_2$. Rollers $28_2$ and 61 are rotatably carried on roller shafts 62 and 65 mounted on the second and third rocker arms $20_2$ and 21, so that they are in rolling contact with the corresponding valve operating cams.

Moreover, the valve operating cams corresponding to the second and third rocker arms $20_2$ and 21 are arranged so that when the rocker arms $19_2$, $20_2$ and 21 are operated relative to one another, the amount of movement of the third rocker arm 21 is largest, and the amount of movement of the first rocker arm $19_2$ is smallest due to the contact with the stopping cam.

A bottomed fitting bore 31, which opens toward the third rocker arm 21, is provided in the second rocker arm $20_2$ in parallel with the rocker arm shaft 22. An opening bore 63 is coaxially provided in a central portion of a closed end of the fitting bore 31. The bottomed cylindrical roller shaft 62 is fitted into the fitting bore 31 for rotation about an axis within the fitting bore 31, and has a closed end which is received on an inner surface of the closed end of the fitting bore 31.

A slit 36 is provided in the second rocker arm $20_2$ to traverse an intermediate portion of the fitting bore 31. The roller $28_2$ is disposed in the slit 36 to coaxially surround the roller shaft 62. A plurality of needle bearings are interposed between the roller $28_2$ and the roller shaft 62. Therefore, the roller $28_2$ is rotatably carried on the roller shaft 62.

A bottomed fitting bore 64, which is open at its opposite ends, is provided in the third rocker arm 21 in parallel with the rocker arm shaft 22. The cylindrical roller shaft 65 is fitted into the fitting bore 64. Moreover, an annular groove 66 is provided around an outer periphery of the roller shaft 65 at one end thereof. A pin 67 is press-fitted into the third rocker arm 21, with a portion thereof engaged into the annular groove 66. Therefore, the roller shaft 65 is fitted in the fitting bore 64 for rotation about an axis, but the axial movement thereof is inhibited.

A slit 68 is provided in the third rocker arm 21 to traverse an intermediate portion of the fitting bore 64. The cylindrical roller 61 is disposed in the slit 68 to coaxially surround the roller shaft 65. A plurality of needle bearings 69 are interposed between the roller 61 and the roller shaft 65. Therefore, the roller 61 is rotatably carried on the roller shaft 65.

A connection switch-over means $\mathbf{38}_2$ is mounted in the first to third rocker arms $\mathbf{19}_2$, $\mathbf{20}_2$ and 21 and is capable of switching over the connection and disconnection of the rocker arms $\mathbf{19}_2$, $\mathbf{20}_2$ and 21. The connection switch-over means $\mathbf{38}_2$ switches between a state in which the rocker arms $\mathbf{19}_2$, $\mathbf{20}_2$ and 21 are independently operated in a lower speed range of operation of the engine, and a state in which the rocker arms $\mathbf{19}_2$, $\mathbf{20}_2$ and 21 are operated in operative association with one another in a higher speed range of operation of the engine.

The connection switch-over means $\mathbf{38}_2$ includes a piston 39 adapted to switch over the connection and disconnection of the first and third rocker arms $\mathbf{19}_2$ and $\mathbf{20}_2$ adjacent each other. A piston 70 is adapted to switch over the connection and disconnection of the third and second rocker arms 21 and $\mathbf{20}_2$ adjacent each other. A limiting member 40 limits the movement of the pistons 39 and 70 toward positions in which the rocker arms $\mathbf{19}_2$, $\mathbf{20}_2$ and 21 are connected to one another. A return spring 41 exhibits a spring force for resiliently biasing the limiting member 40 and the pistons 39 and 70 in a disconnecting direction.

The piston 39 is slidably received in a bottomed slide bore 42 provided in the first rocker arm $\mathbf{19}_2$. A hydraulic pressure chamber $\mathbf{43}_2$ is defined in the first rocker arm $\mathbf{19}_2$ between one end of the piston 39 and a closed end of the slide bore 42. A communication passage $\mathbf{48}_2$ is defined in the first rocker arm $\mathbf{19}_2$ to permit an oil supply passage 44 in the rocker arm shaft 22 to communicate with the hydraulic pressure chamber $\mathbf{43}_2$.

The piston 70 is slidably received in the roller shaft 65 in such a manner that one end thereof is connected to the piston 39 and the other end thereof is connected to the limiting member 40.

The limiting member 40 is slidably received in the roller shaft 62 in such a manner that a flange portion 40*a* thereof is guided on an inner surface of the roller shaft 62. A return spring 41 is mounted between the closed end of the roller shaft 62 and the limiting member 40, and a retaining ring 50 capable of being engaged with the flange portion 40*a* of the limiting member 40 is mounted on the inner surface of one end of the roller shaft 62 to inhibit the releasing of the limiting member 40 from the roller shaft 62.

With such a connection switch-over means $\mathbf{38}_2$, in a lower speed range of operation of the engine, the hydraulic pressure in the hydraulic pressure chamber $\mathbf{43}_2$ is controlled to be at a lower level, and as shown in FIG. 11, the contact end faces of the pistons 39 and 70 are at a location between the first and third rocker arms $\mathbf{19}_2$ and 21, while the contact end faces of the piston 70 and the limiting member 40 are at a location between the third and second rocker arms 21 and $\mathbf{20}_2$. Therefore, the rocker arms $\mathbf{19}_2$, $\mathbf{20}_2$ and 21 are swung relative to one another. Thus, as the first rocker arm $\mathbf{19}_2$ is completely or substantially stopped by the corresponding stopping cam, one of the intake valves is brought into a completely or substantially stopped and closed state. Since the second rocker arm $\mathbf{20}_2$ is swung by the corresponding valve operating cam, the other intake valve is opened and closed. During this time, the third rocker arm 21 is being urged against the corresponding valve operating cam by a resilient means (not shown) and cannot participate in the opening and closing operation of the intake valves.

In a higher speed range of operation of the engine, the hydraulic pressure in the hydraulic pressure chamber $\mathbf{43}_2$ is controlled to be at a higher level, and as shown in FIG. 12, the piston 39 is fitted into the roller shaft 65 of the third rocker arm 21 while urging the piston 70. The piston 70 is fitted into the roller shaft 62 of the second rocker arm $\mathbf{20}_2$ while urging the limiting member 40. Therefore, the rocker arms $\mathbf{19}_2$, $\mathbf{20}_2$ and 21 are brought into their integrally connected states, so that the intake valves are opened and closed, as the third rocker arm 21 is swung by the corresponding valve operating cam.

In the second embodiment, the hydraulic pressure chamber $\mathbf{43}_2$ and the communication passage $\mathbf{48}_2$ are defined in a particular one of the rocker arms $\mathbf{19}_2$, $\mathbf{20}_2$ and 21 to which the roller shafts 62 and 65 and the rollers $\mathbf{28}_2$ and 61 are not mounted, i.e., the first rocker arm $\mathbf{19}_2$ as the cam follower. Therefore, as in the first embodiment, the hydraulic pressure chamber $\mathbf{43}_2$ and the communication passage $\mathbf{48}_2$ can be easily formed in the first rocker arm $\mathbf{19}_2$, while avoiding an increase in size of the first rocker arm $\mathbf{19}_2$. This leads to a simplified assembling operation and a simplified passage construction.

The second and third rocker arms $\mathbf{20}_2$ and 21, with the roller shafts 62 and 65 and the rollers $\mathbf{28}_2$ and 61 mounted thereto, are moved in amounts larger than that of the first rocker arm $\mathbf{19}_2$ during disconnecting by the connection switch-over means $\mathbf{38}_2$. However, the friction resistance can be reduced by the rolling contact of the rollers $\mathbf{28}_2$ and 61 to alleviate the valve operating load.

The roller shaft 62 of the second rocker arm $\mathbf{20}_2$ is urged against the closed end of the fitting bore 31 by a spring force exhibited by the return spring 41 of the connection switch-over means $\mathbf{38}_2$. Therefore, the roller shaft 62 cannot be released from the fitting bore 31. Thus, it is unnecessary to provide a special means for inhibiting the releasing of the roller 62 from the fitting bore 31.

Moreover, the roller shafts 62 and 65 are mounted to the second and third rocker arms $\mathbf{20}_2$ and 21 for rotation about their axes. Hence, as in the first embodiment, the pistons 39 and 70 avoid being brought into vigorous contact with particular points of the inner surfaces of the roller shafts 62 and 65. Thus, it is possible to prevent any unevenly worn portions from being created at particular points of the roller shafts 62 and 65 which enhances the accuracy of switching-over of the connection and disconnection by the connection switch-over means $\mathbf{38}_2$.

The width of the second rocker arm $\mathbf{20}_2$ along the axis of the rocker arm shaft 22 is smaller than that of the second rocker arm $\mathbf{20}_1$ in the first embodiment. Thus, no support wall is provided on the roller shaft 62 of the second rocker arm $\mathbf{20}_2$. However, if the width of the second rocker arm $\mathbf{20}_2$ is set at a relatively large value, a support wall may be provided on the roller shaft 62. If such a support wall is provided, the axial length of the limiting member 40 and the return spring 41 can be relatively shortened while still ensuring a required stroke. Additionally, the weight of the limiting member 40 and the return spring 41, and in turn, of the connection switch-over means $\mathbf{38}_2$ can be reduced, so that the reliability of the limiting member 40 can be enhanced. Moreover, the rigidity of the roller shaft 62 can be enhanced to ensure the smooth rotation of the roller $\mathbf{28}_2$.

The present invention has been described with respect to the intake valves in the embodiments, but is applicable to a valve operating system for exhaust valves. The piston 39 of the connection switch-over means $\mathbf{38}_1$, $\mathbf{38}_2$ is shown as being solid in the embodiments, but the piston 39 may be formed into a cylindrical shape with its axially one end or intermediate portion closed. If the piston 39 is formed in the above manner, the particular cam follower can be reduced in weight, and the friction resistance of the contact portion of the particular cam follower with the stopping cam 25 can be further reduced. Although the embodiments of the present invention have been described in detail, it will be understood that the present invention is not limited to the above-described embodiments, and various modifications in design may be made without departing from the spirit and scope of the invention defined in the claims.

What is claimed is:

1. A valve operating system in an internal combustion engine having a cam shaft, said cam shaft having a valve operating cam and a stopping cam provided thereon, said valve operating system comprising:

a common support member having an oil supply passage;

a plurality of cam followers carried on said common support member, said plurality of cam followers arranged in a direction parallel to an axis of said cam shaft, and said plurality of cam followers operate in response to rotation of said cam shaft, a particular one of said plurality of cam followers is formed with a hydraulic pressure chamber and a communication passage which permits said oil supply passage to communicate with said hydraulic pressure chamber;

a cylindrical roller shaft mounted on at least one of said cam followers other than said particular one cam follower;

a connection switch-over means for switching over a state in which said cam followers are connected to one another and a state in which connection of said cam followers to one another is released, said connection switch-over means including a piston operated in response to a change in hydraulic pressure in said hydraulic pressure chamber, and said connection switch-over means mounted in said plurality of cam followers; and a roller rotatably carried on said cylindrical roller shaft in an arrangement coaxial with said piston in a connected state of said connection switch-over means, said roller being in rolling contact with the valve operating cam provided on said cam shaft, wherein said particular one of said plurality of cam followers is operated a smallest amount when said connection switch-over means is in a disconnected state.

2. A valve operating system in an internal combustion engine according to claim 1, wherein said particular one cam follower is disposed at one end of an arrangement of said plurality of cam followers.

3. A valve operating system in an internal combustion engine according to claim 1, wherein said particular one cam follower is in direct contact with said stopping cam, which is provided on said cam shaft, in such a manner that operation of said particular one cam follower is completely or substantially stopped in the disconnecting state of said connection switch-over means.

4. A valve operating system in an internal combustion engine according to claim 1, wherein said connection switch-over means includes said piston which is axially movable to switch connection and disconnection of adjacent cam followers, a limiting member limiting movement of said piston to a position permitting the adjacent cam followers to be connected, and a return spring exhibiting a spring force and resiliently biasing said limiting member and said piston toward said hydraulic pressure chamber, wherein said limiting member being received in said cylindrical roller shaft which is mounted to the at least one cam follower disposed on an opposite side from said particular one cam follower, said particular one cam follower disposed at one end of an arrangement of the plurality of cam followers, wherein said return spring being accommodated in said cylindrical roller shaft, and wherein said cylindrical roller shaft has a radially inward protruding support wall integrally provided on an inner surface at a location corresponding to an axially intermediate portion of said roller, said return spring being received on said support wall, therein limiting movement of said limiting member with the movement of said piston to the position permitting the adjacent cam followers to be connected.

5. A valve operating system in an internal combustion engine according to claim 4, wherein said support wall is formed having an axial length substantially as long as an entire axial length of said roller.

6. A valve operating system in an internal combustion engine according to claim 1, wherein said cylindrical roller shaft is mounted on the at least one of the cam followers for rotation about an axis thereof.

7. A valve operating system in an internal combustion engine according to claim 1, wherein said particular one cam follower is integrally provided with a cam slipper which is in direct contact with one of cams of the cam shaft corresponding to said particular one cam follower and said cam slipper has a width smaller than an axial width of said roller.

8. A valve operating system in an internal combustion engine according to claim 1, wherein a width of said particular one cam follower is smaller than a width of the at least one cam follower other than said particular one cam follower.

9. A valve operating system in an internal combustion engine according to claim 1, wherein said connection switch-over means includes said piston which is axially movable to switch over connection and disconnection of adjacent cam followers, a limiting member limiting movement of said piston to a position permitting the adjacent cam followers to be connected, and a return spring exhibiting a spring force and resiliently biasing said limiting member and said piston toward said hydraulic pressure chamber, wherein the at least one cam follower being disposed on an opposite side from the particular one cam follower, the particular one cam follower being disposed at one end of an arrangement of the plurality of cam followers, said at least one cam follower is provided with a fitting bore which opens at least at one end thereof in a direction of the arrangement of said cam followers, and wherein said cylindrical roller shaft being fitted in said fitting bore and is provided at one end thereof with a flange portion engaged with one end face of said at least one cam follower in the direction of the arrangement of said cam followers, said return spring being mounted between said cylindrical roller shaft and said limiting member which is slidably fitted in said cylindrical roller shaft.

10. A valve operating system according to claim 4, wherein an annular step is provided around an outer periphery of one end of said cylindrical roller shaft which faces toward said particular one cam follower and a retaining ring is mounted to engage the annular step.

5,845,614
15 16

* * * * *